United States Patent [19]

Mobley

[11] Patent Number: 4,869,436

[45] Date of Patent: Sep. 26, 1989

[54] LAMINATOR UNWIND ROLL STAND

[75] Inventor: George A. Mobley, Roebuck, S.C.

[73] Assignee: Milliken Research Corporation, Spartanburg, S.C.

[21] Appl. No.: 229,254

[22] Filed: Aug. 8, 1988

[51] Int. Cl.[4] ..... B65H 16/08; B65H 19/18

[52] U.S. Cl. ..... 242/58.4; 242/68.7

[58] Field of Search ..... 242/58, 58.1, 58.2, 242/58.3, 58.4, 58.5, 68.7

[56] References Cited

U.S. PATENT DOCUMENTS

| | | | |
|---|---|---|---|
| 1,591,597 | 7/1926 | Williamson | 242/58.2 |
| 2,134,656 | 10/1938 | Breth | 242/68 |
| 2,435,376 | 2/1948 | Wilcoxon | 242/58.4 |
| 3,077,069 | 2/1963 | Kooistra | 57/127.5 |
| 3,360,209 | 12/1967 | De Rochi | 242/58 |
| 3,394,897 | 7/1968 | Martin, Sr. | 242/54 |
| 3,412,950 | 11/1968 | Martin, Sr. | 242/54 |
| 3,468,529 | 9/1969 | Martin, Sr. et al. | 270/31 |
| 3,582,010 | 6/1968 | Whiteman | 242/58 |
| 3,972,487 | 8/1976 | Costa | 242/68.7 |
| 3,977,617 | 8/1976 | Salmon | 242/58 X |
| 4,084,761 | 4/1978 | Kuckhermann | 242/58.6 |
| 4,131,501 | 12/1978 | Böttcher et al. | 242/58.4 X |
| 4,165,842 | 8/1979 | Mengel | 242/58.3 |
| 4,290,834 | 9/1981 | Buettel | 242/58.4 X |
| 4,363,695 | 12/1982 | Marass | 242/58.4 X |
| 4,450,039 | 5/1984 | Salvucci et al. | 242/58.5 X |
| 4,469,286 | 9/1984 | Greding | 242/65 |
| 4,632,325 | 12/1986 | Feyerl et al. | 242/55 |
| 4,668,328 | 5/1987 | Kyytsönen | 242/58.5 X |
| 4,778,122 | 10/1988 | Snygg | 242/58.6 |

*Primary Examiner*—Joseph J. Hail, III

*Attorney, Agent, or Firm*—Earle R. Marden; H. William Petry

[57] ABSTRACT

A method and apparatus to continuously unwind fabric or material from a roll stand by splicing a new roll of material to a roll of material being unwound without interrupting the supply of material to a material consuming machine. The unwinding apparatus includes a mechanism to drop the shaft of the dissipated roll while the spliced new roll is supplied to the fabric consuming machine.

3 Claims, 4 Drawing Sheets

LAMINATOR UNWIND ROLL STAND

This invention relates to an efficient unwind roll stand which allows easy and efficient replacement of an exhausted fabric roll supplying fabric to another point of use such as a lamination machine.

Unwind stands for material such as paper, fabric, etc. have been known for years but replacement of an exhausted roll of material in a continuous operation has always been a problem. First the old, almost exhausted roll of material has to be attached to the new supply of material and then, when the new material has been placed in communication with the material consuming machine, the shaft and/or roll of the exhausted material must be removed from the unwind machine.

Therefore, it is an object of the invention to provide a new and novel material unwind stand which provides ready replacement of an exhausted supply of material with a new supply of material.

Other objects and advantages of the invention will become readily apparent as the specification proceeds to describe the invention with reference to the accompanying drawings, in which.

Figure 1:
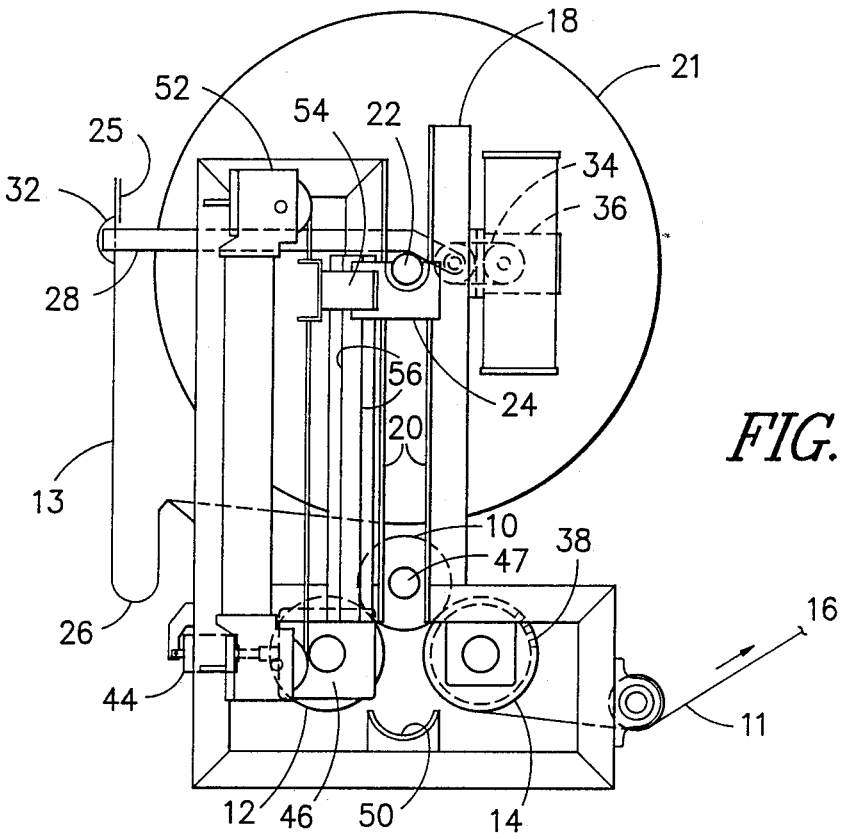
FIGS. 1–6 are schematic representations of the various steps in replacing a spent roll of material in an unwind machine.

In the preferred form of the invention the unwind stand is supplying fabric continuously to an extruder laminator which is laminating paper to the back of the fabric being supplied from the unroll stand. This, obviously, is only the preferred use of the herein-described invention since the type of material being unwound and its end use is not critical.

In normal operating position the supply roll 10 of fabric 11 rests on free turning bed rolls 12 and 14 and is pulled therefrom around the perforated roll 14 towards the laminator (not shown) in the direction indicated by the reference number 16. The fabric roll 10, the free turning rolls 12 and 14 and the rest of the roll stand apparatus are supported on a suitable frame 18 which provides a slot 20 therein to allow a replacement fabric roll 21 to be mounted on the roll stand while the fabric from the roll 10 is being supplied to the laminator.

When the roll of fabric 10 runs down to a diameter of approximately 8 inches the reserve or replacement roll 21 is placed in the position shown in FIGS. 1–4 with its shaft 22 located in the slidable bearings 24. Prior to positioning the roll, the end of the fabric on the roll has been folded back and temporarily taped. Also a double-sided adhesive tape 25 has been placed on the outside of the fold so that the tape 25 will be facing the roll 21 when the fabric 13 is manually unrolled to provide the tension loop 26 as shown in FIG. 1. Then, after the replacement roll 21 has been placed in position, the vacuum bar, consisting of a pair of spaced arms 28 and vacuum chamber 32 extending therebeween, is pivoted from its neutral position (FIGS. 3–6) to the position shown in FIG. 1 by a suitable chain 34 and drive motor 36. In the position shown in FIG. 1 the fabric 13 is held to the perforated face of the vacuum chamber 32 between the arms 28. A suitable source of vacuum pressure (not shown) is connected to the vacuum chamber 32 and the roll 14 for reasons hereinafter explained.

Figure 2:
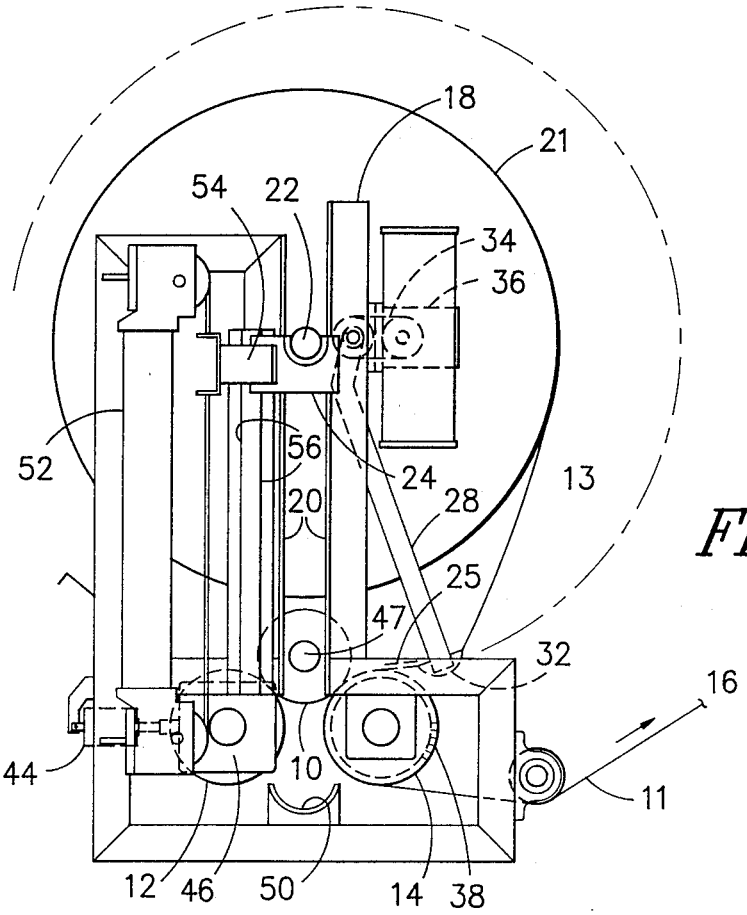
Figure 3:
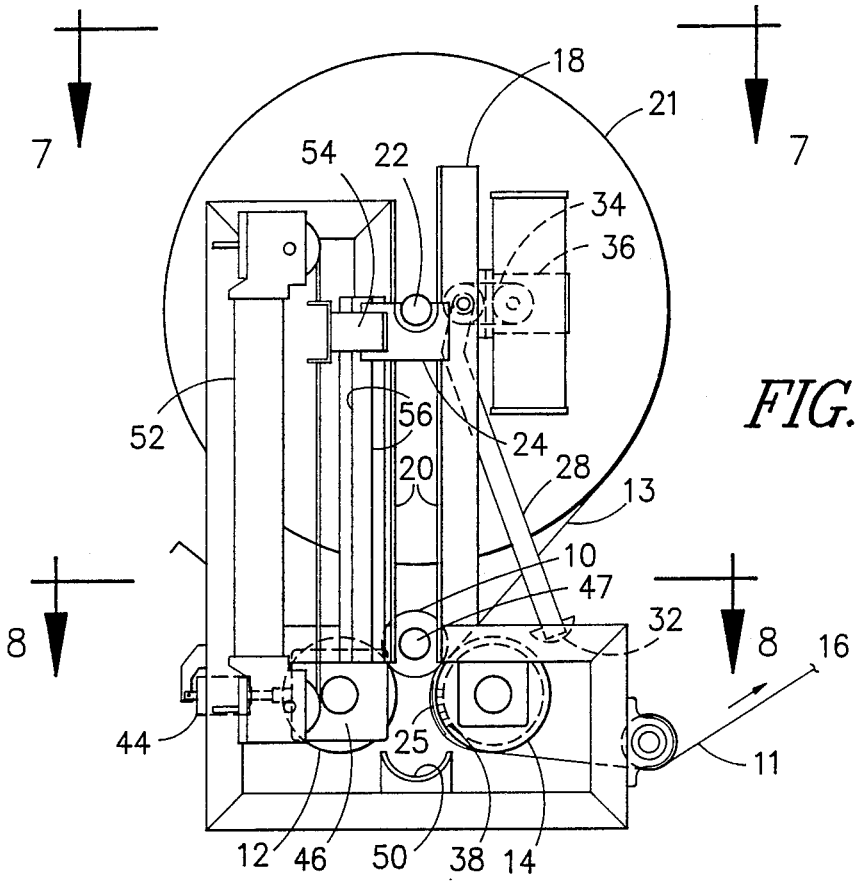

After the fabric 13 has been secured against the perforated face of the vacuum chamber 32 the drive motor 36 is reversed to pivot the arm 28 and the end of the fabric 13 to the waiting position shown in FIG. 2. At this position the vacuum pressure is maintained on the fabric 13 until it is desired to splice the new roll 21 to the old roll 10 being dissipated.

When the roll 10 has been reduced to the point where it is necessary to splice the fabric 11 of the roll 10 to the fabric 13 on the replacement roll 21, the vacuum induced in the vacuum chamber 32 is reduced or shut down while a vacuum is pulled on the inside of the roll 14. When the perforated portion 38 of the roll 14 rotates to a point under the tail of the replacement roll of fabric 21, the fabric 13 will be attached thereto and pulled away from the vacuum bar 32. The roll 14 carries the taped tail of the replacement roll fabric 13 into the nip with the old fabric 11 where the double-sided stick tape adheres to the fabric 11 of the roll 10 to provide a splice 42 between the fabrics 11 and 13 on rolls 10 and 21, respectively.

Figure 4:
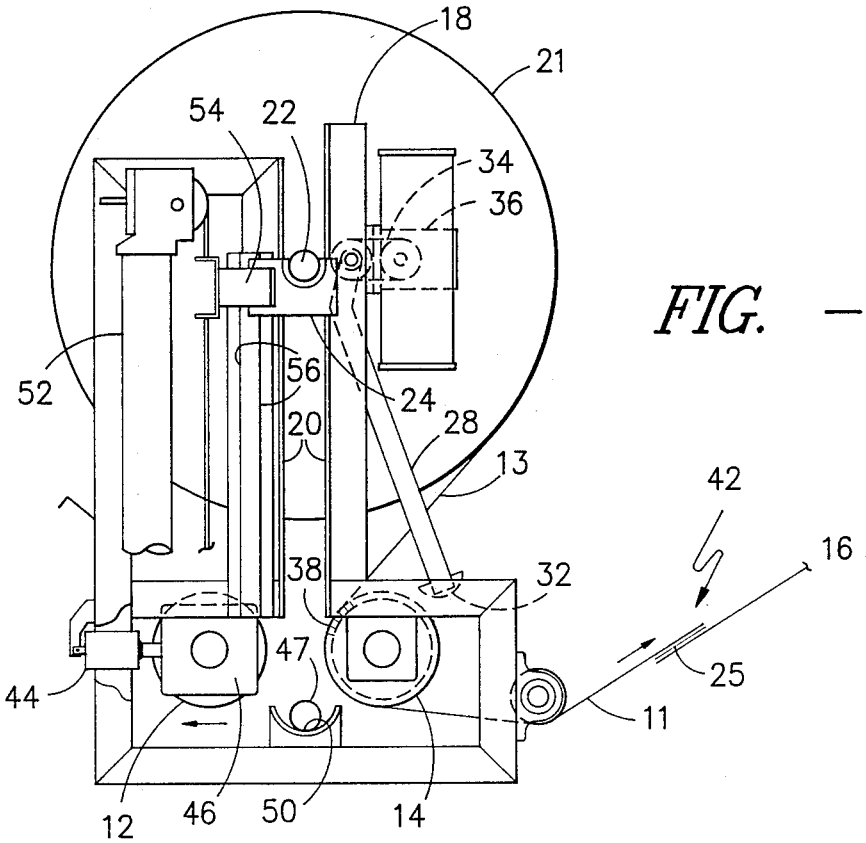
Figure 5:
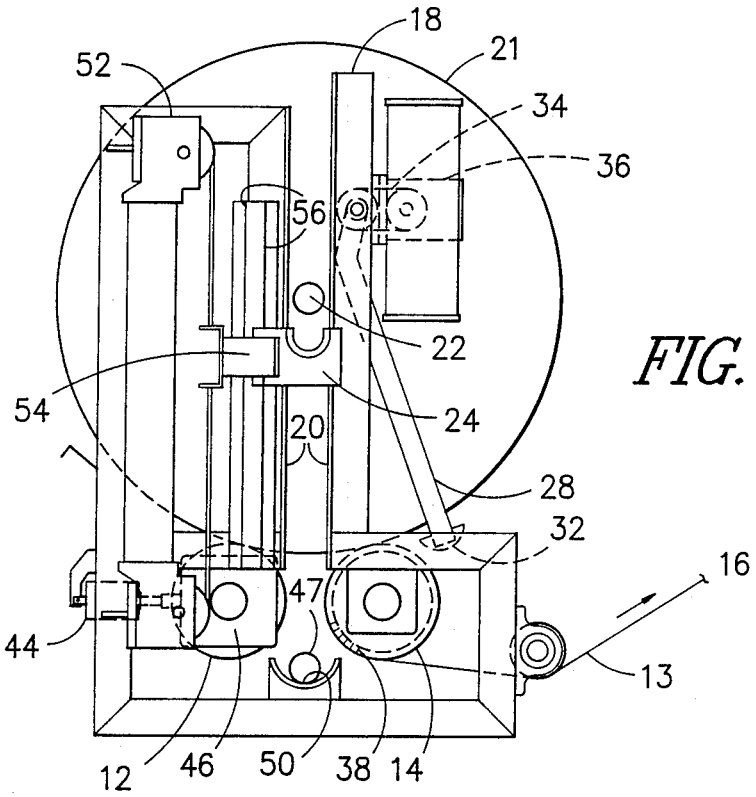
Figure 6:
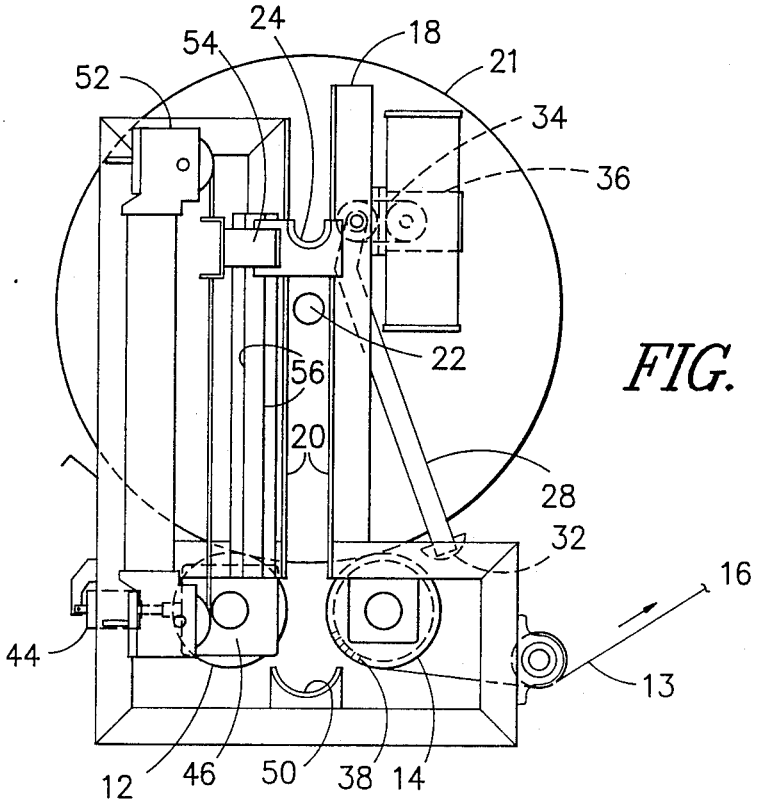
Figure 7:
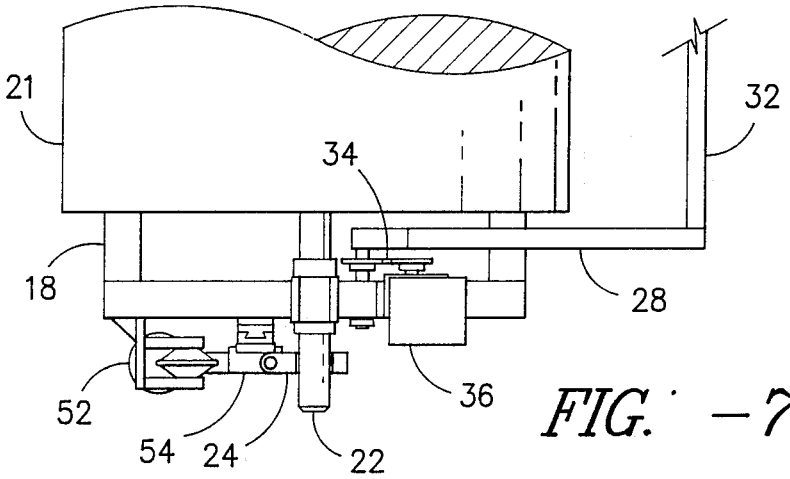
FIG. 7 is a view taken on line 7—7 of FIG. 3.
Figure 8:
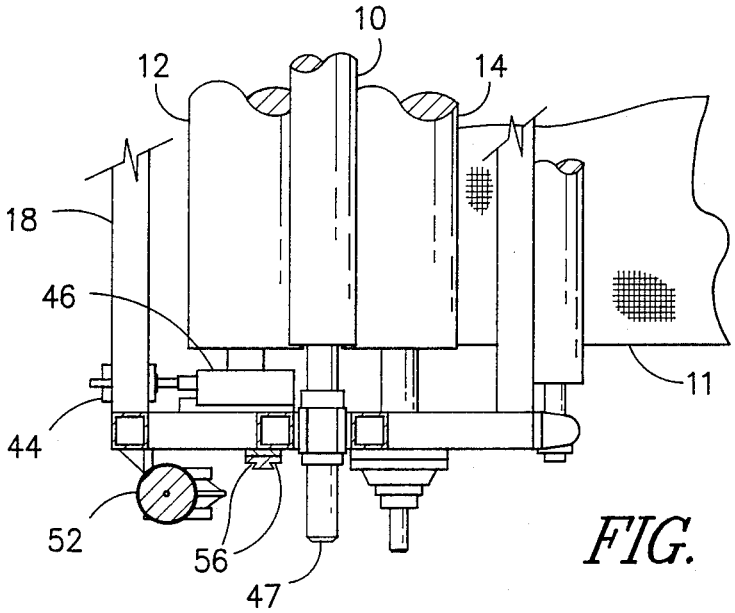
FIG. 8 is a partial sectional view taken on line 8—8 of FIG. 3.
Figure 9:
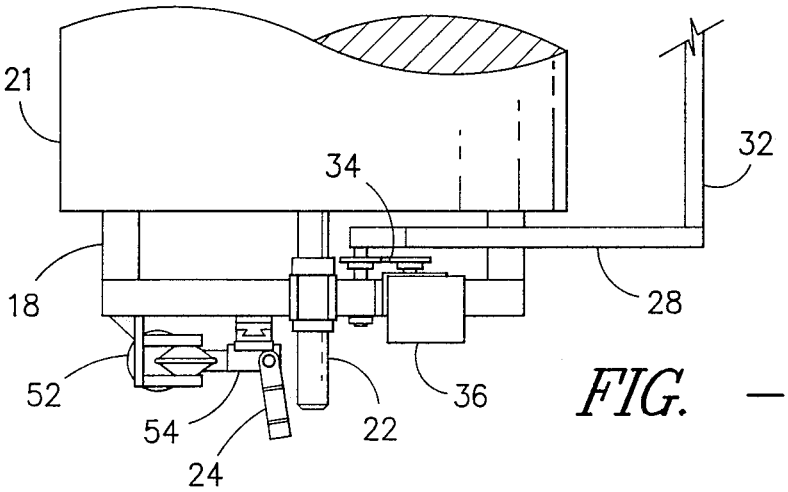
FIG. 9 is a view similar to FIG. 7 showing the shaft support pivoted out of operational position.

After the splice 42 has been made, the piston 44 will be activated to pull the bearing block 46 for the roll 12 outward to allow the shaft 47 of the exhausted fabric roll 10 to drop into the semicircular support 50 (FIGS. 4 and 5). After the exhausted roll shaft 47 has dropped into the support 50 the action of the piston 44 will be reversed to slide the roll 12 back into operative position (FIG. 5) and the cable cylinder 52 actuated to lower the bearings 24, by movement of the slide member 54 in the guide groove 56, to allow the replacement roll 21 to contact the bed rolls 12 and 14. When the roll 21 has been placed in operative position on the bed rolls 12 and 14 the bearings 24 will be pivoted outwardly (FIG. 9) so that the bearings 24 can be slid upwardly and then pivoted inwardly (FIG. 6) ready for engagement by the shaft of a replacement roll for the roll 21 being consumed.

It can be seen that the herein-described material roll stand provides for ease of splicing a replacement roll to the tail of an almost exhausted roll of material without interrupting the process using the material coming from the roll stand. Furthermore, the apparatus described provides ready removal of the exhausted material roll shaft while allowing continuous supply of material to a consuming machine such as a laminator.

Although the preferred embodiment of the invention has been described, it is contemplated that many changes may be made without departing from the scope or spirit of the invention and it is desired that the invention be limited only by the claims.

I claim:

1. Method to continuously unwind a web of material in an apparatus having a pair of bed rolls to support a roll of web material comprising the steps of: placing a first roll of web material on the bed rolls and supplying said web material to a material consuming source, mounting a second roll of web material above the first roll of web material when the diameter of the first roll has been reduced to a predetermined minimum, placing a double sided tape on a tail of the second roll of web material, moving the tail of the second roll of web material onto one of the bed rolls and temporarily holding it in a waiting position with a vacuum pressure means, adhering the tail of the first roll of web material to the second roll of web material by bringing a tail of the first roll into engagement with the double-sided tape to splice it thereto, sliding one roll of the bed rolls away from the other bed roll allowing a shaft of the first roll of web material to drop therebetween when the first roll has been exhausted, sliding the one roll of the bed rolls back into operative relationship with the other bed roll and dropping the second roll of web material into operating position on the pair of bed rolls.

2. Apparatus to continuously unwind a first roll of material comprising: a frame, a pair of freely rotatably mounted bed rolls mounted to said frame to support a roll of material, a first means operably associated with one of said bed rolls to periodically slide said one roll away from the other of said bed rolls, a second means slidably mounted in said frame above said bed rolls to support a replacement roll of material, a third means mounted on said frame for splicing material of the roll being unwound to maerial of the replacement roll mounted above said bed rolls, and a fourth means to activate said first means to slide said one roll away from said other roll when material from the replacement roll has been spliced to material from the roll being unwound to allow a shaft of the roll being unwound to drop therebetween and to slide said one roll back into operative position when the shaft has dropped therebetween.

3. The apparatus of claim 2 wherein said second means includes a plurality of pivotally mounted bearing supports to support a replacement roll shaft.

* * * * *